United States Patent [19]

Schroeder

[11] 4,342,028

[45] Jul. 27, 1982

[54] CABLE DRUM ROTATION INDICATOR

[75] Inventor: James C. Schroeder, Two Rivers, Wis.

[73] Assignee: The Manitowoc Company, Inc., Manitowoc, Wis.

[21] Appl. No.: 210,325

[22] Filed: Nov. 25, 1980

[51] Int. Cl.[3] ..... G08B 1/00

[52] U.S. Cl. ..... 340/407; 116/205; 340/671

[58] Field of Search ..... 340/407, 670, 671, 672; 254/290, 266, 342; 116/205, DIG. 17; 242/57

[56] References Cited

U.S. PATENT DOCUMENTS

| | | | |
|---|---|---|---|
| 2,754,505 | 7/1956 | Kenyon | 116/205 X |
| 2,776,814 | 1/1957 | Sparks | 116/205 X |
| 4,098,221 | 7/1978 | Mickelson | 116/205 |

*Primary Examiner*—John W. Caldwell, Sr.
*Assistant Examiner*—Daniel Myer
*Attorney, Agent, or Firm*—Leydig, Voit, Osann, Mayer & Holt, Ltd.

[57] ABSTRACT

A drum rotation indicator for a power driven cable drum operated by a control lever, which includes an arbor rotatably mounted within the control lever and having an exposed end with a thimble-like recess. An electric motor rotates the arbor, and the motor is driven by a signal generator driven by the cable drum. A control circuit triggers operation of the motor in one direction or the other upon rotation of the generator in one direction or the other, and a tachometer driven by the motor limits the effect of the generator so that motor speed is held proportional to generator speed.

4 Claims, 2 Drawing Figures

CABLE DRUM ROTATION INDICATOR

This invention relates generally to cable drum assemblies and more particularly concerns rotation indicating devices for cable drums.

Winch drums for wire cables such as those used in heavy lift cranes are often driven through motors and clutches, commonly hydraulic, having hand-operated control levers whose positions are not necessarily directly related to rotational movement of the drum. In many crane designs, the operator cannot directly observe the drum to ascertain movement and speed, and often the distances between the operator and the crane tip or the load block makes it impossible for an operator to observe the effect of his control lever movements. Further, variations between no load at all and extremely heavy loads vary the reactions of a cable drum and its drive to movement of its control lever.

The art has suggested the use of instrument meters to display cable drum movement, and of "slave" drums or disks mechanically coupled to a drum and positioned within an operator's sight or touch. Each of these approaches adds a separate device for the physical attention of the operator, and thereby to that extent distracts the operator from his controls and the work region.

It is the primary aim of the present invention to provide a cable drum rotation indicator that gives an operator a tactile sense of the speed and direction of drum rotation without requiring the operator to alter his hand or eye movements in controlling his apparatus.

Another object of the invention is to provide an indicator as characterized above that gives a reliable rotation indication to the operator even at low drum speeds.

A further object is to provide an indicator as described above that uses standard electrical and electrical-mechanical components so as to be reliable and relatively inexpensive to manufacture and maintain.

Figure 1:
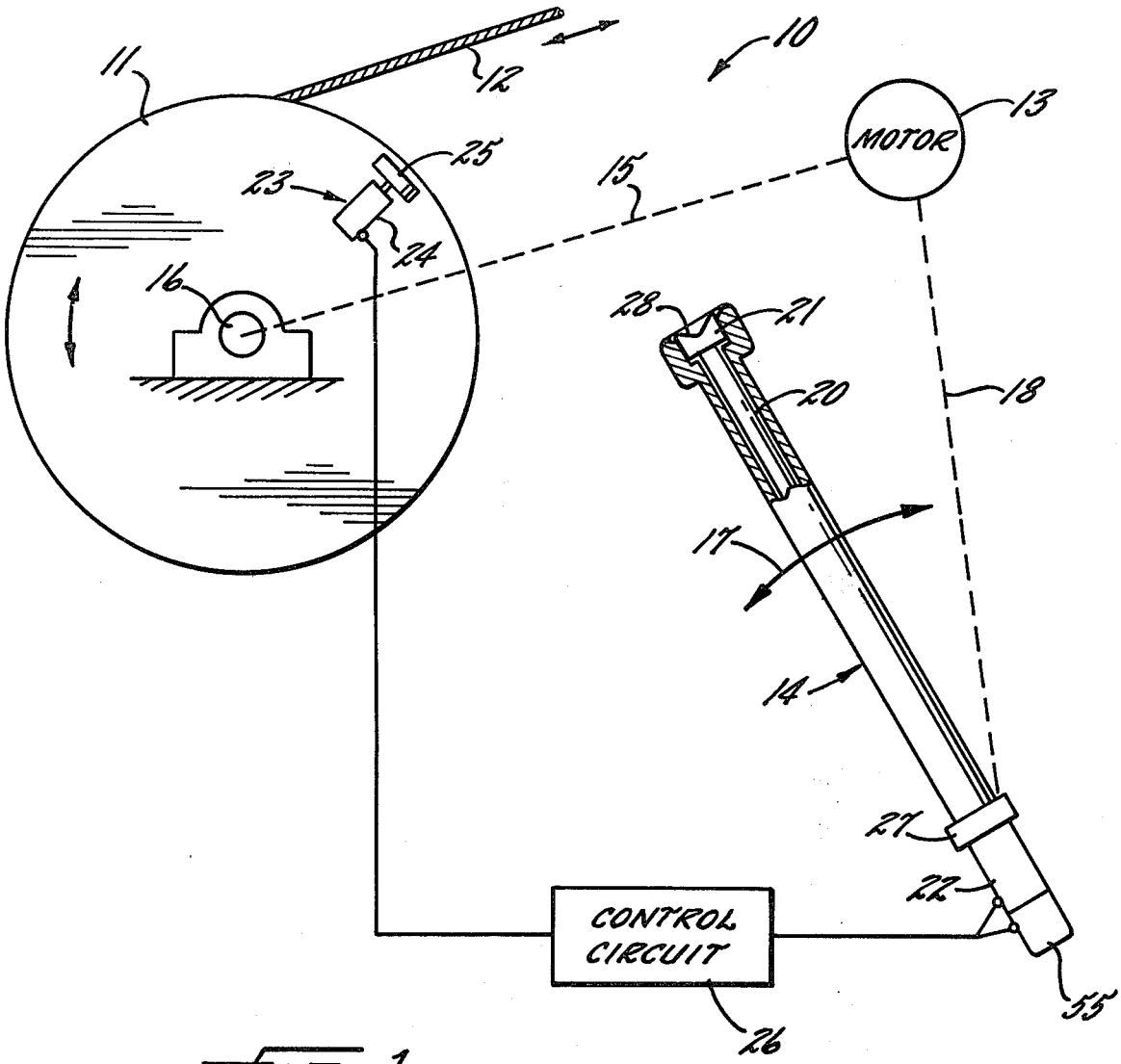
Figure 2:
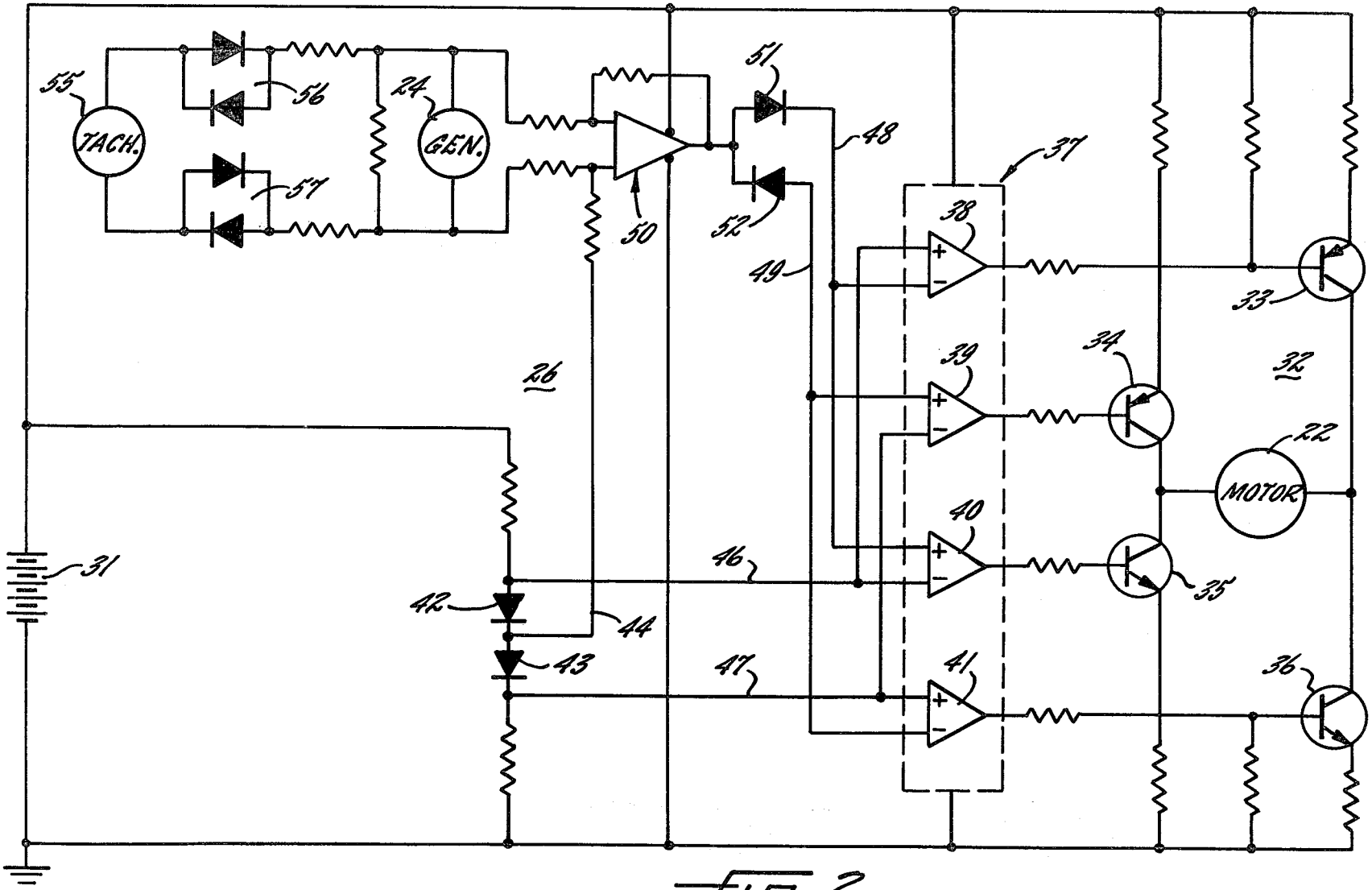

Other objects and advantages of the invention will become apparent upon reading the following detailed description and upon reference to the drawings, in which:

FIG. 1 is a schematic representation of a cable drum assembly including the invention; and FIG. 2 is a diagram of the control circuit used in the assembly of FIG. 1.

While the invention will be described in connection with a preferred embodiment, it will be understood that I do not intend to limit that invention to that embodiment. On the contrary, I intend to cover all alternatives, modifications and equivalents as may be included within the spirit and scope of the invention as defined by the appended claims.

Turning now to FIG. 1, there is shown a power-driven cable drum assembly 10 including a drum 11, on which a cable 12 is wound, that is driven by a motor assembly 13 under the control of a control lever 14.

Typically, the motor assembly 13 includes a power plant and a variable speed clutch, often hydraulic, which itself can be thought of as embodying a power source or pump and a motor directly coupled, as indicated by the line 15, to the axle shaft 16 of the drum 11. Regardless of the particular form of motor assembly utilized, the control lever 14 is mounted for movement through an arc indicated by the arrow 17, and is connected as represented by a line 18 to the motor assembly so as to cause that assembly to drive the drum 11 in one direction or the other, depending upon which way the lever is swung along the arrow 17, and at a rotational speed depending upon how far the lever is swung.

In carrying out the invention, an arbor 20 is mounted within and substantially coaxially with the lever 14 with an exposed end 21, a reversible variable speed motor 22 is coupled to rotationally drive the arbor 20, and a signal generator or power source 23 coupled to drive the motor 22 is positioned to be driven by the drum 11. In this way, rotation of the drum 11 causes rotation of the arbor 20 which can be felt by the operaor's hand in contact with the arbor end 21 while he manipulates the lever 14.

Preferably, the motor 22 is a d-c. electrical motor and the power source includes an electric generator 24 rotated by a wheel 25 in frictional contact with the drum so that the output of the generator 24 is proportional to drum rotational speed. The generator 24 is coupled to the motor 22 through a control circuit 26 forming part of the power source 23 and which drives the motor 22 at a much greater speed than drum speed. For this reason, a speed-reducing gear box 27 is interposed between the motor 22 and the arbor 20.

As a feature of the invention, the arbor end 21 is formed with a thimble-like recess 28 into which the operator can put the tip of his thumb or finger while holding the lever naturally, thus getting a reliable tactile sense of rotation.

The control circuit 26 portion of the power source 23 (see FIG. 2) includes a power supply 31 and a switching circuit 32 triggered to drive the motor 22 in one direction upon rotation of the generator 24 in one direction and to drive the motor in the other direction upon rotation of the generator in the other direction. The switching circuit 32 includes transistors 33, 34, 35 and 36 coupled to the motor 22 across the power supply 31. When transistors 33 and 35 are turned on by current signals applied to their bases, the motor 22 is driven in one direction, and when transistors 34 and 36 are turned on, the motor 22 is oppositely driven.

The switching circuit 32 is triggered by a quad comparator integrated circuit 37 including comparator amplifiers 38, 39, 40 and 41. Fixed bias voltages, positive and negative, are created by a pair of diodes 42 and 43 connected across the power supply 31 and a zero voltage connection 44. The amplifiers 38–41 are biased through lines 46 and 47 either positively or negatively as is appropriate to hold their respective transistors 33–36 in the cut-off condition. It can be seen that a positive signal voltage on a line 48 that is greater than the bias voltages applied to the amplifiers 38 and 40 will swing the outputs of the amplifiers and cause the associated transistors 33 and 35 to conduct. Similarly, a negative signal voltage on a line 49 that is greater than the bias voltage on the amplifiers 39 and 41 will swing the output of those amplifiers and cause the transistors 34 and 36 to conduct.

The generator 24 provides signal voltages for triggering the transistors 33–36 through the circuit 37 via a precision, high gain amplifier 50 which, with only a small voltage from the generator rotating very slowly, creates a sufficiently high output, either plus or minus through the diodes 51 and 52, to exceed the bias voltages applied to the comparator circuit 37. Thus, initial, even slow, rotation of the generator 24 triggers through the circuit 37 the application of the full power supply 31 voltage to the motor 22 in a direction corresponding to the direction of generator rotation.

To regulate the speed of the motor 22 in relation to the rotational speed of the generator 24, a voltage generating tachometer 55 (see also FIG. 1) is mounted adjacent to and is driven by the motor 22. The tachometer 55 output is coupled to the generator 24 through diode sets 56 and 57 so as to balance the output of the generator 24. The diodes provide sufficient electrical resistance at low voltages that as the motor 22 accelerates, the motor must drive the tachometer 55 at a sufficient speed to generate a voltage overcoming the diode resistance, whereupon continued motor-tachometer acceleration produces a voltage to match and cancel the output of the generator 24. As soon as generator output through the amplifier 50 falls below the bias voltages applied to the comparator circuit 37, drive of the motor 22 is interrupted and the motor stops accelerating. In this way, motor speed is kept proportional to generator output, which is proportional to drum rotational speed.

Those skilled in this art will appreciate that the indicator and its circuit 26 described comprises standard electrical and electrical-mechanical components so as to be reliable and relatively inexpensive to manufacture and to maintain. The operator of the cable drum assembly can observe the work and control the lever 14 in the normal fashion, but he has, literally at his fingertips, a reliable tactile sensation of whether or not the drum is rotating, the direction it is rotating, and how fast it is rotating.

I claim as my invention:

1. For use with a power driven cable drum controlled by a hand positioned operator's lever, a drum rotation indicator comprising, in combination, an arbor mounted within and substantially coaxially with said lever, said arbor having an end exposed for physical contact with the hand of an operator using said lever, a reversible variable speed motor coupled for rotating said arbor within said lever, a power source coupled for driving said motor and positioned to be driven by said drum so that rotation of said drum causes rotation of said arbor which can be felt by the operator.

2. The combination of claim 1 in which said arbor end is formed with a thimble-like recess for receiving the tip of an operator's thumb or finger to give a reliable tactile sense of rotation.

3. The combination of claim 1 in which said motor is an electrial motor and said power source includes a generator whose output is proportional to drum speed, said power source also including a power supply and a switching circuit triggered to drive said motor in one direction upon rotation of said generator in one direction and to drive the motor in the other direction upon rotation of the generator in the other direction.

4. The combination of claim 3 including a tachometer coupled to be driven by said motor, said tachometer being coupled to said generaor so as to balance the output of the generator and thus interrupt triggering of said switching circuit, thereby limiting motor speed in proportion to generator output.

* * * * *